US005682008A

United States Patent [19]

Chervinsky et al.

[11] Patent Number: 5,682,008

[45] Date of Patent: Oct. 28, 1997

[54] MONOLITHIC SEMICONDUCTOR IGNITER FOR EXPLOSIVES AND PYROTECHNIC MIXTURES AND A PROCESS FOR MANUFACTURING THEREFORE

[75] Inventors: Shmuel Chervinsky, Nesher; Michael Avinor, Haifa, both of Israel

[73] Assignee: State of Israel Rafael - Armament Development Authority, Haifa, Israel

[21] Appl. No.: 446,974

[22] Filed: May 22, 1995

[30] Foreign Application Priority Data

May 31, 1994 [IL] Israel ..... 109841

[51] Int. Cl.[6] ..... F42B 3/13

[52] U.S. Cl. ..... 102/202.7; 102/202.5

[58] Field of Search ..... 102/202.5, 202.7, 102/202.8, 202.9

[56] References Cited

U.S. PATENT DOCUMENTS

| | | | |
|---|---|---|---|
| 3,135,200 | 6/1964 | Jackson | 102/202.9 |
| 3,292,537 | 12/1966 | Goss, Jr. | 102/202.9 |
| 3,362,158 | 1/1968 | Thurston et al. | 102/202.8 |
| 3,366,055 | 1/1968 | Hollander, Jr. . | |
| 4,363,272 | 12/1982 | Simmons | 102/202.13 |
| 4,471,697 | 9/1984 | McCormick et al. | 102/202.14 |
| 4,708,060 | 11/1987 | Bickes, Jr. et al. . | |
| 4,843,964 | 7/1989 | Bickes, Jr. et al. . | |
| 4,862,803 | 9/1989 | Nerheim et al. | 102/202.5 |
| 4,869,170 | 9/1989 | Dahmberg et al. . | |
| 4,893,563 | 1/1990 | Baginski | 102/202.2 |
| 4,976,200 | 12/1990 | Benson et al. . | |
| 5,029,529 | 7/1991 | Mandigo et al. . | |
| 5,085,146 | 2/1992 | Baginski . | |
| 5,094,166 | 3/1992 | Hendley, Jr. . | |
| 5,355,800 | 10/1994 | Dow et al. | 102/202.2 |
| 5,385,097 | 1/1995 | Hruska et al. | 102/202.5 |

FOREIGN PATENT DOCUMENTS

| | | | |
|---|---|---|---|
| 6679 | 4/1904 | United Kingdom | 102/202.8 |
| 2191566 | 12/1987 | United Kingdom | 102/202.5 |

OTHER PUBLICATIONS

Periodic Table of the Elements, E.H. Sargent and Co. 1962.

*Primary Examiner*—Michael J. Carone
*Assistant Examiner*—Christopher K. Montgomery

[57] ABSTRACT

A monolithic semiconductor igniter for igniting a charge of explosive material. The igniter includes a semiconductor substrate, and one or more fuse which is diffused in the semiconductor substrate such that the fuse ignites the charge when an electrical current is passed through it. Also provided is a process for manufacturing a monolithic semiconductor igniter. The process includes providing a semiconductor substrate, and diffusing one or more fuses in the semiconductor substrate. An additional embodiment provides an igniter with multiple sawtooth bridge elements. The resistance of this igniter may be adjusted by cutting individual bridge elements.

29 Claims, 7 Drawing Sheets

MONOLITHIC SEMICONDUCTOR IGNITER FOR EXPLOSIVES AND PYROTECHNIC MIXTURES AND A PROCESS FOR MANUFACTURING THEREFORE

FIELD AND BACKGROUND OF THE INVENTION

The present invention relates to semiconductor based igniters for the ignition of explosives and pyrotechnic mixtures in general and, in particular, to monolithic semiconductor igniters. The present invention further relates to a process for manufacturing a monolithic semiconductor igniter.

Various types of igniters, including the more recent semiconductor based igniters, for the ignition of explosives are known in the art.

An example of an early semiconductor based (SCB) igniter is disclosed in U.S. Pat. No. 3,366,055 to Hollander. The operation of the igniter is based on the principle that a sharp changeover from extrinsic to intrinsic conduction can be matched to the auto-ignition temperature of a specific high explosive such that a shock wave can be established capable of detonating the explosive. This igniter suffers from the disadvantage that certain aspects of its performance are difficult to control.

An example of an improved semiconductor based igniter is disclosed in U.S. Pat. No. 4,708,060 to Bickes et al. The igniter utilizes a bridge for igniting an explosive charge by means of a combination of ignition/initiation effects when an electrical current is passed therethrough. The effects include a process of heating, the formation of a thin plasma and a convective shock effect. This igniter suffers from a relatively expensive manufacturing process, electrostatic discharge (ESD) sensitivity and the requirement of matching a semiconductor layer to a substrate.

There is therefore a need for a low cost, efficient semiconductor based igniter which does not suffer from the above-mentioned disadvantages.

SUMMARY OF THE INVENTION

The main object of the present invention is for a semiconductor based igniter for the ignition of explosives in general and in particular for relatively insensitive high explosives including, but not limited to, PETN, HNAB, HMX, pyrotechnics, sensitive primaries, gunpowders, etc.

Hence, the objective of the present invention is achieved, according to a first aspect of the present invention, by providing a monolithic semiconductor igniter for igniting a charge of explosive material, comprising: (a) a semiconductor substrate; and (b) at least one fuse diffused in the semiconductor substrate such that the at least one fuse ignites the charge when an electrical current is passed therethrough.

The igniter can be implemented by either diffusing a n-type fuse in a p-type substrate or, alternatively, a p-type fuse in a n-type substrate. In both cases, the fuse is diffused in either a crystalline or a polycrystalline semiconductor substrate through doping the semiconductor substrate to a level of about $10^{19}$ dopant atoms/cc. The igniter is typically packaged in conventional packaging and housing, for example, TO-18 packaging which includes insulated glass-metal pins for electrical connection to the outside environment.

The fuse is generally H-shaped having two diffused pads and a bridge extending between the pads. The pads are used for electrically connecting the fuse to the insulated glass-metal pins of the igniter's packaging. The fuse typically includes at least one rectangular bridge or at least one saw toothed bridge. A bridge typically has an area of between about 1,000 $\mu m^2$ and about 40,000 $\mu m^2$ and a depth of between about 0.5 μm and about 10 μm, thereby establishing a total bridge volume of between about 500 $\mu m^3$ to about $4\times10^5$ $\mu m^3$.

It should be noted that the monolithic semiconductor igniter of the present invention is similar to the semiconductor based igniter as described in the above mentioned U.S. Pat. No. 4,708,060 in terms of its ignition of a charge of explosive material on passing an electrical current therethrough. However, the monolithic semiconductor igniter, constructed and operative according to the teachings of the present invention, provides a unique set of advantages over the above referenced device which include that it can be manufactured from conventional silicon substrates using highly conventional integrated circuit manufacturing techniques which makes it inexpensive and easily mass produced.

Hence, according to a second aspect of the present invention, there is provided a process for manufacturing a monolithic semiconductor igniter, comprising the steps of: (a) providing a semiconductor substrate; and (b) diffusing at least one fuse in the semiconductor substrate. The fuse is generally H-shaped including a pair of diffused pads and a bridge extending between the pads. Typically, the fuse includes at least one generally rectangular bridge or at least one generally saw-tooth bridge.

BRIEF DESCRIPTION OF THE DRAWINGS

The invention is herein described, by way of example only, with reference to the accompanying drawings, wherein.

DESCRIPTION OF THE PREFERRED EMBODIMENTS

Figure 1A:
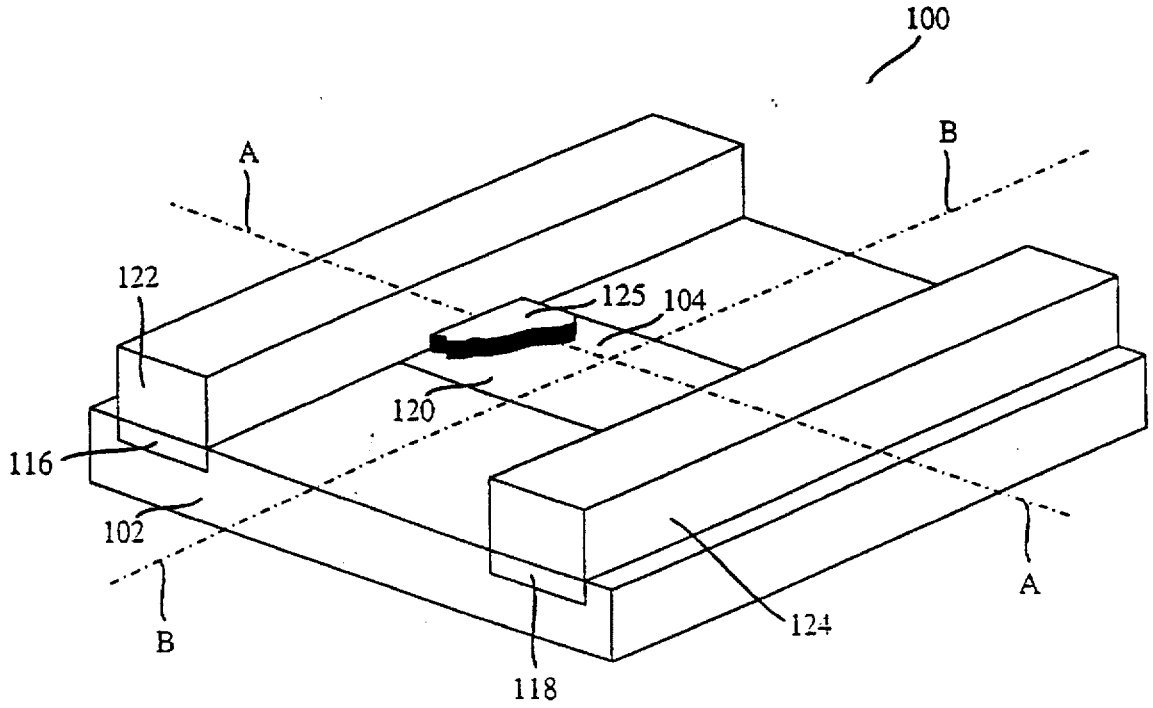
FIG. 1*a* shows a schematic illustration of a preferred embodiment of a monolithic semiconductor igniter constructed and operative according to the teachings of the present invention.
Figure 1B:
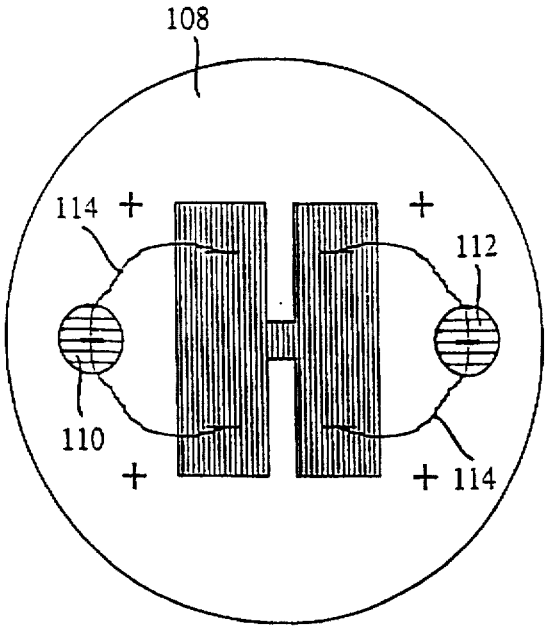
FIG. 1*b* shows a schematic illustration of the monolithic semiconductor igniter packaged in TO-18 conventional packaging.
Figure 1C:
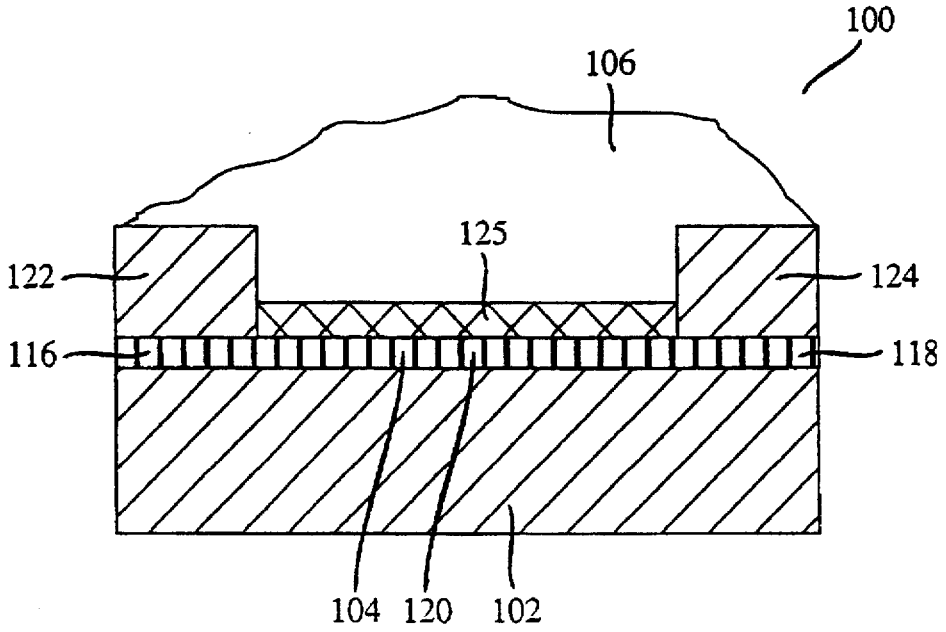
FIGS. 1*c* and 1*d* show cross-sectional views of the igniter along lines A—A and B—B, respectively, shown in FIG. 1*a;*
Figure 1D:
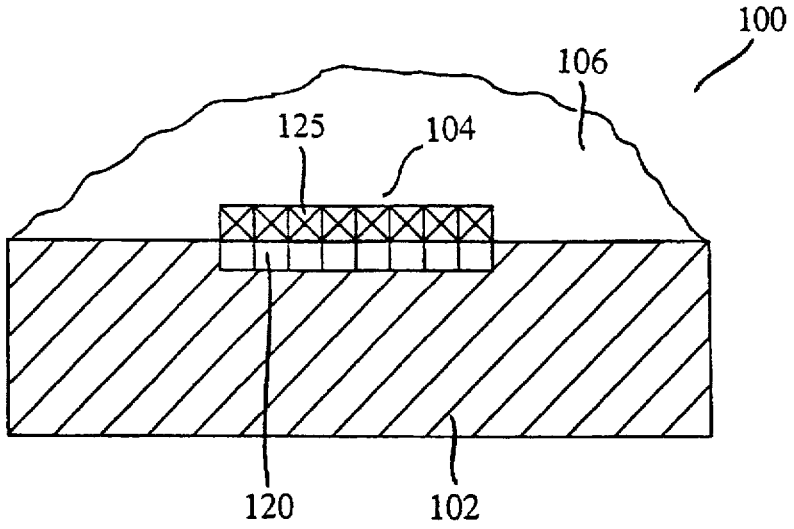

The present invention is of a monolithic semiconductor igniter for the ignition of explosives in general and in particular for relatively insensitive high explosives including, but not limited to, PETN, HNAB, HMX, pyrotechnics, sensitive primaries, gunpowders, etc. The present invention is also of a process for manufacturing a monolithic semiconductor igniter.

The principles and operation of the monolithic semiconductor igniter of the present invention may be better understood with reference to the drawings and the accompanying description.

With reference now to the drawings, FIGS. 1*a*–1*d* illustrate a preferred embodiment of a monolithic semiconductor igniter, generally designated 100, constructed and operative according to the teachings of the present invention. Monolithic semiconductor igniter 100 generally includes a substrate 102 containing a fuse 104 for the ignition of a charge 106 (see FIG. 1*c*) of explosive material which acts as a precursor in a chain reaction to eventually detonate an explosive or pyrotechnic charge. Igniter 100 is typically encapsulated within a conventional housing or package 108, for example, the TO-18 package, having insulated metal-glass pins 110 and 112 for electrical connection to the igniter's external environment.

Substrate 102 is preferably prepared from either a single element semiconductor material but also binary, ternary, quaternary, etc. alloys. These may be taken from any of the usual combinations of materials from Groups III–IV of the periodic table, inter alia. Non-limiting examples include germanium, indium arsenide, gallium arsenide, $Ga_{1-x}In_xAs$, $GaAs_{1-x}P_x$, etc. However, silicon-based materials are preferred for essentially the same reasons that such materials are preferred for most semiconductor applications.

Igniter 100 can be implemented by either diffusing a n-type fuse in a p-type substrate or, alternatively, a p-type fuse in a n-type substrate. In both cases, fuses 104 are preferably diffused in substrates 102 by doping semiconductor substrates 102 at or near its saturation level of approximately $10^{19}$ atoms/cc. Doping substrate 102 at this level renders an electrical resistivity of fuse 104 in the order of $10^{-3}$ to $10^{-4}$ Ωcm. Doping levels lower by a factor of 2 of this value are also implementable for the purposes of this invention.

Fuse 104 preferably has an H-shaped geometry having diffused pads 116 and 118 connected by a rectangular bridge 120. Pads 116 and 118 are preferably covered with metallized lands 122 and 124, respectively, leaving only bridge 120 uncovered for intimate contact with charge 106. Lands 122 and 124 are connected to external insulated metal-glass pins 110 and 112, respectively, by means of aluminum, gold or similar electrical conductive wires 114.

Charge 106 is mounted in intimate contact with igniter 100 such that it is ignited when an electric current is passed through fuse 104. Charge 106 is fabricated from a number of substances which display the properties of either a low ignition temperature, for example, between about 250° and about 350° or being readily ignitable by relatively low inputs of energy. In the preferred embodiment of igniter 100, charge 106 is preferably fabricated from lead stypnate which has an ignition temperature of about 282° C. Charge 106 typically includes 0.1 g of lead stypnate such that charge 106 requires about 0.5–1.0 mJ heat for its ignition. To facilitate the ignition of charge 106, a layer 125 of SiO, $SiO_2$ or similar readily sublimable material having a sublimation temperature between about 1,000° C. and about 3,000° C. can be preferably applied to cover bridge 120 such that layer 125 is intermediate bridge 120 and charge 106.

Figure 2A:
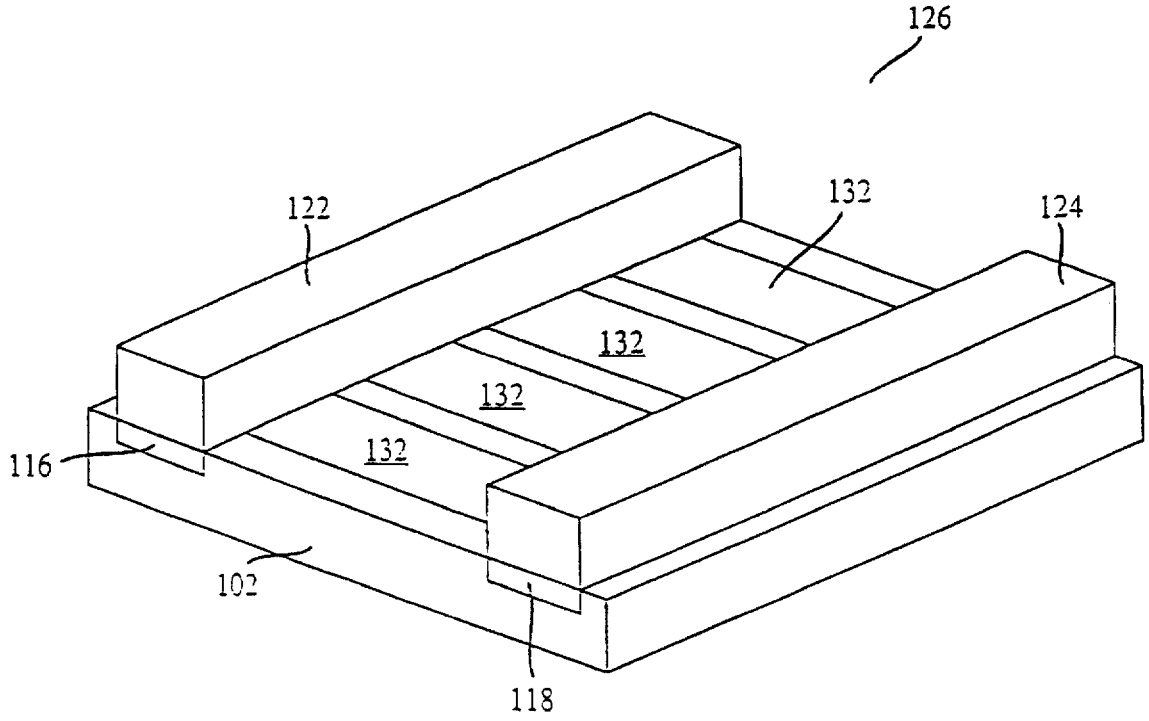
FIGS. 2*a*–2*c* show elevation views of igniters having other configurations of fuses.
Figure 2B:
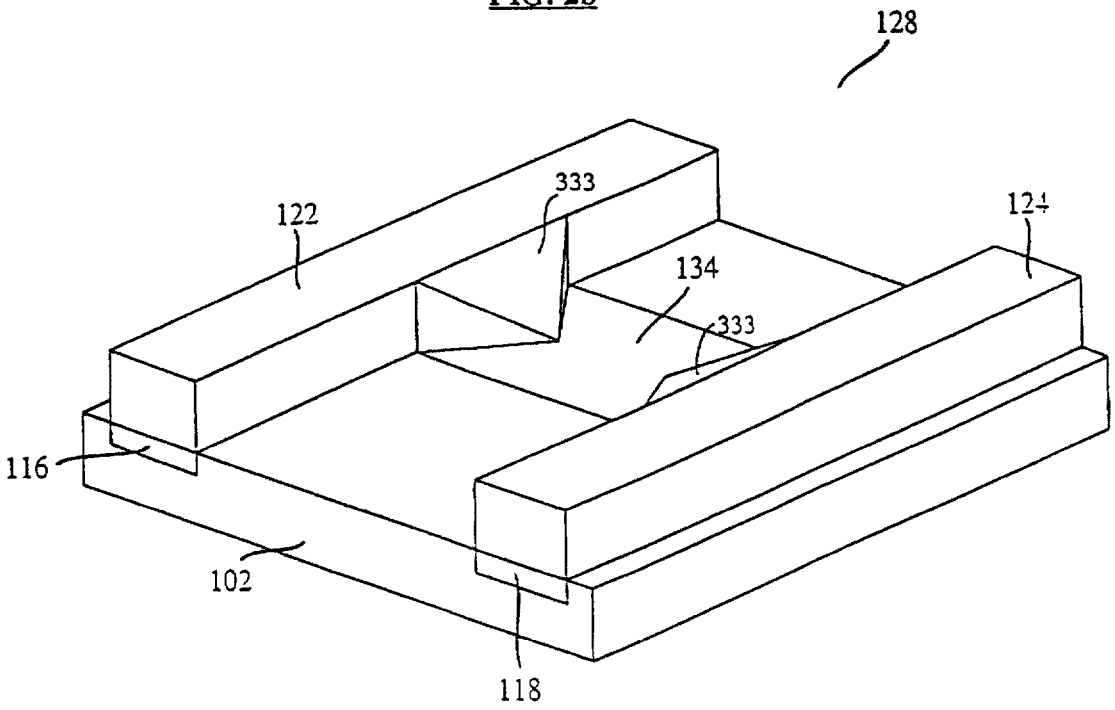
Figure 2C:
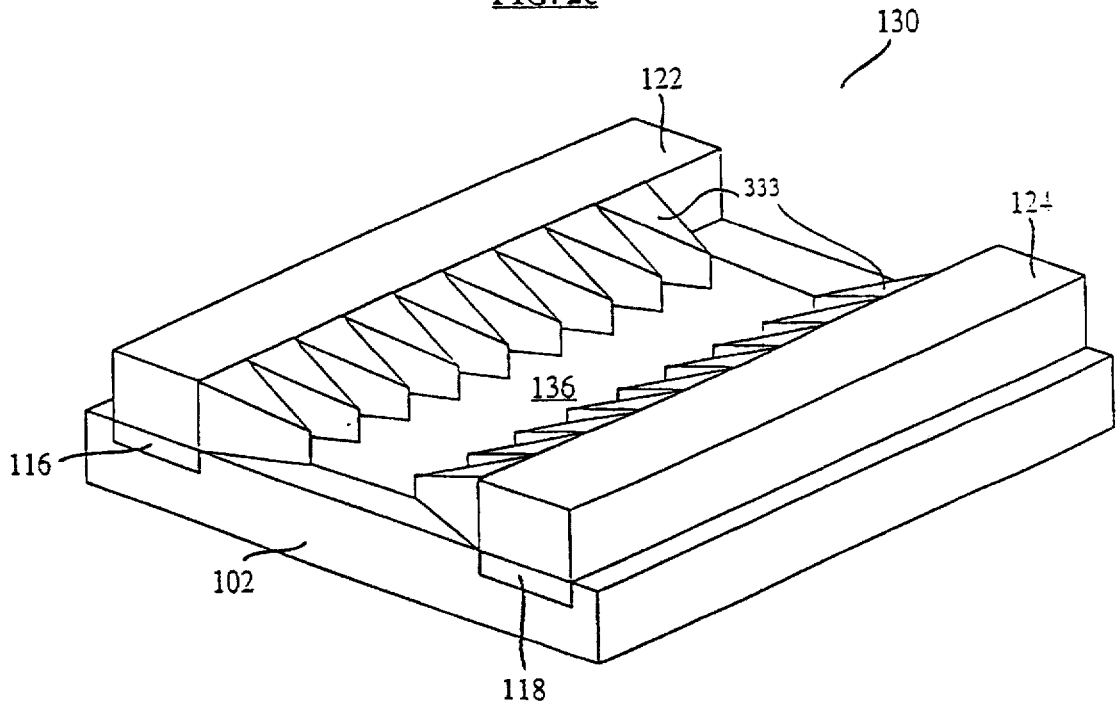

With reference now to FIGS. 2*a*–2*c*, there are shown other configurations of igniters, generally designated 126, 128 and 130, respectively. In particular, rather than a single bridge extending between pads 116 and 118, igniter 126 includes a plurality of generally rectangular shaped bridges 132 diffused in parallel on substrate 102 such that the resistance of igniter 126 can be adjusted by the cutting of one or more of bridges 132 by a laser or other suitable means as required. In a similar fashion, igniter 128 includes a single saw-tooth bridge 134 while igniter 130 includes a multi-staggered saw-tooth bridge 136 for strengthening the efficiency of the ignition process of charge 106. A "sawtooth" is a triangular contact extension protruding on a bridge, as in FIGS. 2B and 2C, indicated by reference numeral 333.

All in all, bridges 132, 134 and 136 typically have areas of between about 1,000 $\mu m^2$ and about 40,000 $\mu m^2$ and thicknesses of between about 0.5 μm and about 10 μm, thereby establishing total bridge volumes of between about 500 $\mu m^3$ and about $4\times10^5$ $\mu m^3$.

Regardless of the configuration of its fuse, igniter 100 is engineered to conform to the recognized industry-wide standards, including MIL-STD-1512, which regulate the operation and activation of igniters and detonators. Among other requirements, the standards stipulate that fuses have a resistance of no more than 1 Ω at room temperature and that fuses pass a "no-fire" safety test which requires that no fires be initiated when at least 1W of power is applied across a 1 Ω fuse for 5 minutes or more. Other design requirements of igniter 100 include that it has a ruggedness to withstand loading pressures of 30,000 psi and greater and is resistant to ESD or other unintentional voltages.

Igniter 100 can be operated at low voltages in the order of 10V or less and therefore is compatible with other digital electronic apparatus which might be employed in conjunction therewith and can be integrated onto the same chip or adjacent wafers as hybrids. For example, the igniter can be directly integrated with other device components including, but not limited to, logic circuits, for example, sating logic, fire sets, switching circuits etc. In addition, because the igniter of the present invention has low power demands, it can be employed in cascade configurations to form large assemblies that can be precisely timed and controlled using conventional digital electronics in conjunction with power supplied by a single firing set.

Igniter 100 ignites charge 106 by virtue of a combination of ignition/initiation effects including a process of heating, the formation of a thin plasma and a thermal convective shock wave when an electrical current is passed therethrough. However, for the sake of clarity, two modes of ignition of charge 106 are now described using igniter 100. In the first mode of operation, a relatively low voltage in the order of 10V and a current of about 3A is applied across pins 110 and 112 for about 25 msec. such that bridge 110 acts as a thermal element to ignite charge 106. In the second mode of operation, a relatively high voltage in the order of 100V and a current of between about 10A and about 20A is applied across pins 110 and 112 for 10 μsecs, such that bridge 120 acts as a plasma generator due to its evaporation at an approximate temperature of 2,000°–3,000° C. to ignite charge 106. Overall, a pulse as short as 0.1–100 μsec at an energy of approximately 0.5–10 mJ is required to ignite charge 106.

Figure 3A:
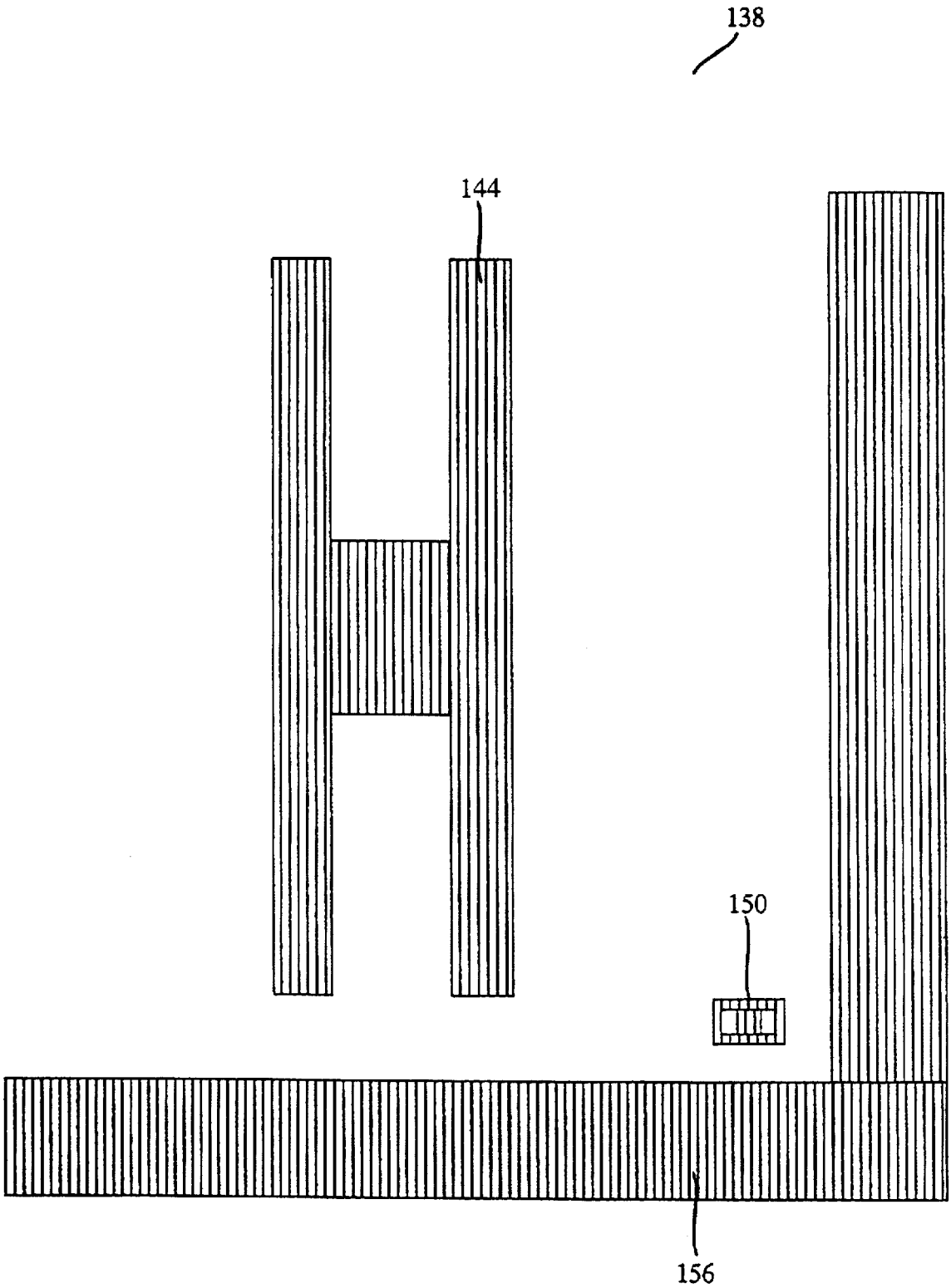
FIGS. 3*a*–3*c* show the masks required for the fabrication of the preferred embodiment of the monolithic semiconductor igniter.
Figure 3B:
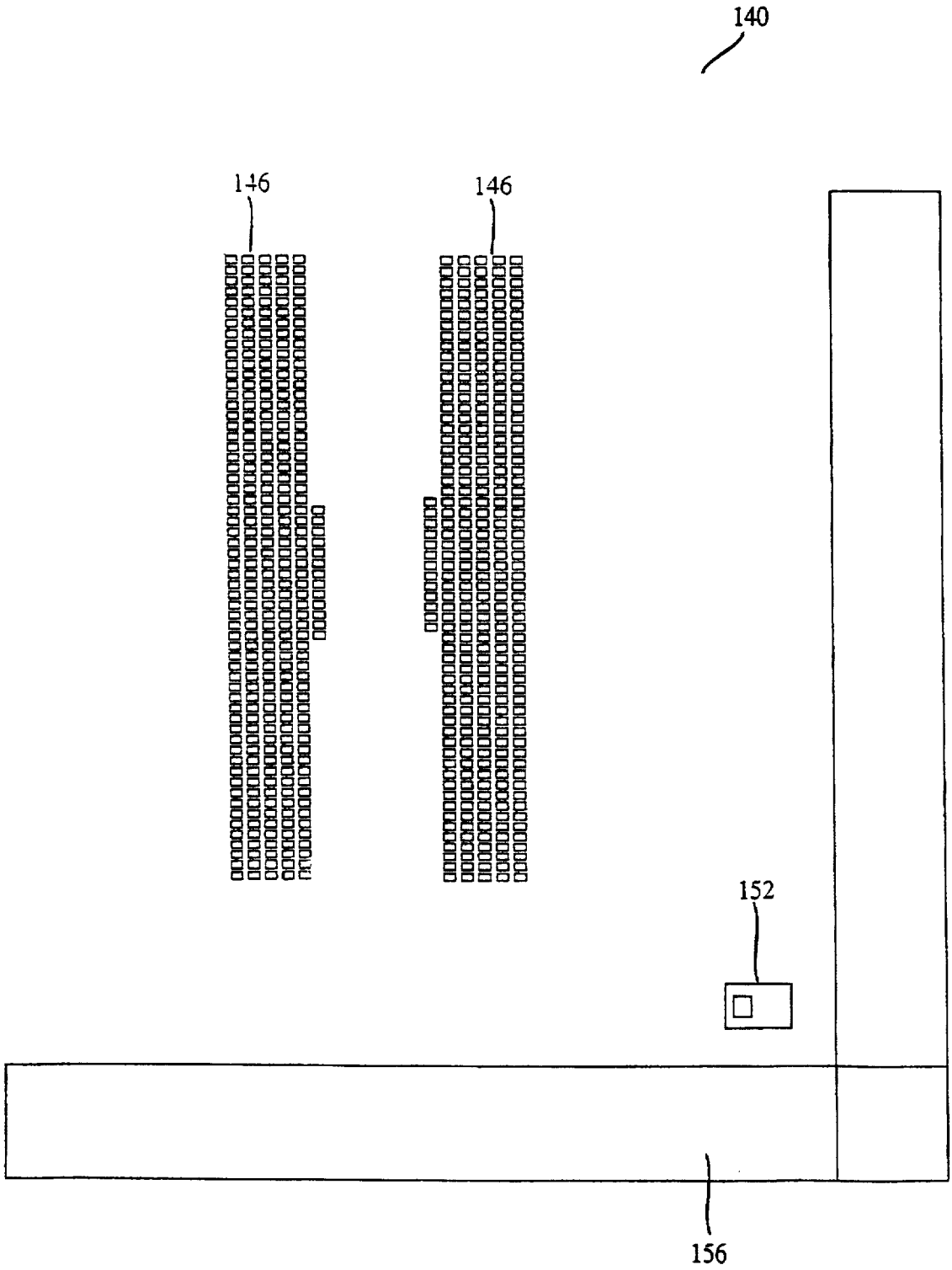
Figure 3C:
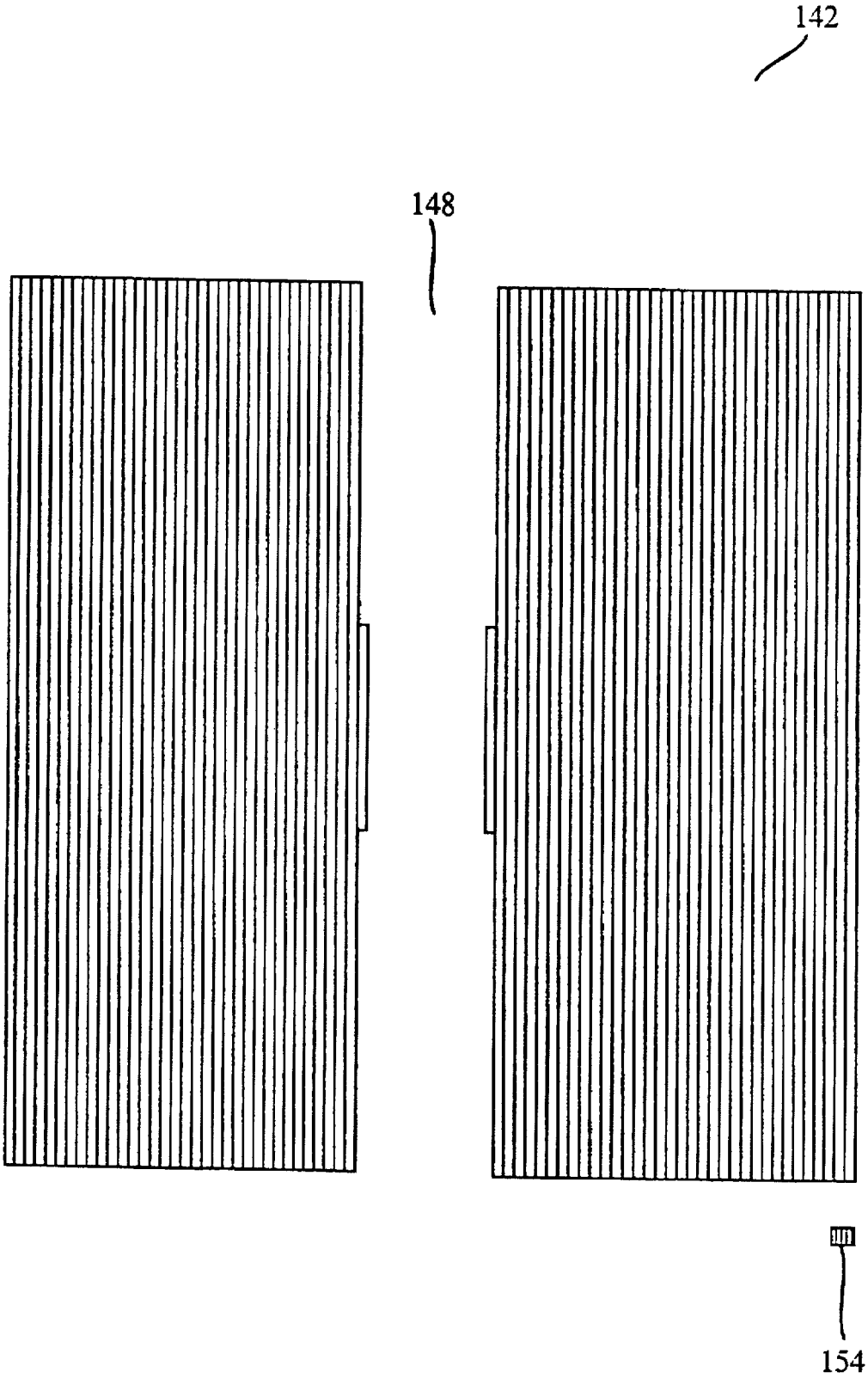

It is a particular advantage of the present invention, that igniter 100 is fabricated according to highly conventional integrated circuit manufacturing method employing at least three masks 138, 140 and 142 shown in FIGS. 3*a*–3*c*, respectively, to fabricate fuse 104 having rectangular bridge 120. As can be seen, mask 138 has a substantially H-shaped aperture 144 for preparation of fuse 104, mask 140 has a pair of substantially rectangular apertures 146 for preparation of good ohmic contacts and mask 142 has a substantially rectangular aperture 148 for the preparation of metallized lands. Registration between masks 138, 140 and 142 is enabled by means of registration patterns 150, 152 and 154 while cutting of individual igniters is achieved by scribe line 156. Similar masks are used to fabricate fuses 132, 134 and 136.

While the invention has been described with respect to a limited number of embodiments, it will be appreciated that many variations, modifications and other applications of the invention may be made.

What is claimed is:

1. A monolithic semiconductor igniter for igniting a charge of explosive material, comprising:

(a) a semiconductor substrate;

(b) at least one bridge diffused in said semiconductor substrate such that said at least one bridge ignites the charge when an electrical current is passed therethrough; and, (c) a facilitating layer of sublimable material covering said at least one diffused bridge, such that said facilitating layer of sublimable material is intermediate between said bridge and the charge of explosive material;

(d) a pair of diffused pads with said at least one diffused bridge extending between said pads.

2. The igniter as in claim 1, wherein said semiconductor substrate is fabricated from p-type material and said bridge is fabricated from n-type material.

3. The igniter as in claim 1, wherein said semiconductor substrate is fabricated from n-type material and said bridge is fabricated from p-type material.

4. The igniter as in claim 1, wherein said substrate is a crystalline semiconductor material.

5. The igniter as in claim 1, wherein said substrate is a polycrystalline semiconductor material.

6. The igniter as in claim 1, wherein said substrate is doped to a level of about $10^{19}$ dopant atoms/cc to form said bridge.

7. The igniter as in claim 1, wherein the electrical resistance of the igniter is about 1 Ω.

8. The igniter as in claim 1, wherein the igniter includes at least one generally rectangular bridge.

9. The igniter as in claim 1, wherein the igniter includes at least one generally sawtooth contact extension protruding on said bridge, for strengthening the efficiency of the ignition process.

10. The igniter as in claim 1, wherein the area of said bridge is between about 1,000 $\mu m^2$ and about 400,000 $\mu m^2$.

11. The igniter as in claim 1, wherein the depth of said bridge is between about 0.5 μm and about 10 μm.

12. The monolithic semiconductor igniter of claim 1, wherein the material of said facilitating layer of sublimable material covering said at least one diffused bridge, such that said facilitating layer of sublimable material is intermediate between said bridge and the charge of explosive material, has a sublimation temperature between about 1000° C. and about 3000° C.

13. A process for manufacturing a monolithic semiconductor igniter, comprising the steps of:

(a) providing a semiconductor substrate;

(b) diffusing at least one bridge in said semiconductor substrate; and, (c) providing a facilitating layer of sublimable material covering said at least one diffused bridge, such that said facilitating layer of sublimable material is intermediate between said bridge and the charge of explosive material; wherein the igniter includes a pair of diffused pads with said at least one diffused bridge extending between the pads.

14. The process as in claim 13, wherein said semiconductor substrate is fabricated from p-type material and said bridge is fabricated from n-type material.

15. The process as in claim 13, wherein said semiconductor substrate is fabricated from n-type material and said bridge is fabricated from p-type material.

16. The process as in claim 13, wherein said substrate is a crystalline semiconductor material.

17. The process as in claim 13, wherein said substrate is a polycrystalline semiconductor material.

18. The process as in claim 13, wherein said step of diffusing said at least one bridge is such that said substrate is doped to a level of about $10^{19}$ dopant atoms/cc to form said at least one bridge.

19. The process as in claim 13, wherein the igniter includes at least one generally rectangular bridge.

20. The process as in claim 13, wherein the igniter includes at least one generally saw-tooth bridge.

21. The process as in claim 13, wherein the area of said bridge is between about 1,000 $\mu m^2$ and about 400,000 $\mu m^2$.

22. The process as in claim 13, wherein the depth of said bridge is between about 0.5 μm and about 10 μm.

23. The process of claim 13, wherein the material of said facilitating layer of sublimable material covering said at least one diffused bridge has a sublimation temperature between about 1000° C. and about 3000° C.

24. A process for manufacturing a monolithic semiconductor igniter, comprising the steps of:

(a) providing a semiconductor substrate;

(b) diffusing at least one bridge in said semiconductor substrate; and, (c) providing a facilitating layer of sublimable material covering said at least one diffused bridge, such that said facilitating layer of sublimable material is intermediate between said bridge and the charge of explosive material;

wherein the material of said facilitating layer of sublimable material covering said at least one diffused bridge is selected from the list consisting of SiO and SiO2.

25. A monolithic semiconductor igniter for igniting a charge of explosive material, comprising:

(a) a semiconductor substrate;

(b) at least one bridge diffused in said semiconductor substrate such that said at least one bridge ignites the charge when an electrical current is passed therethrough; and, (c) a facilitating layer of sublimable material covering said at least one diffused bridge, such that said facilitating layer of sublimable material is intermediate between said bridge and the charge of explosive material;

wherein the material of said facilitating layer of sublimable material covering said at least one diffused bridge is selected from the list consisting of SiO and SiO2.

26. A monolithic semiconductor igniter comprising a semiconductor substrate containing at least two bridges diffused between diffused pads, wherein (a) the resistance of the igniter is adjustable by cutting at least one of said bridges; and, (b) said bridges are covered by a facilitating layer of sublimable material.

27. A process for manufacturing a monolithic semiconductor igniter comprising (a) providing a semiconductor substrate containing at least two bridges diffused between diffused pads;

(b) adjusting the resistance of the igniter by cutting at least one of said bridges; and, (c) covering said bridges by a facilitating layer of sublimable material.

28. A process for igniting a precursor charge (106) of explosive material, comprising (a) providing a monolithic semiconductor igniter, including at least one bridge (120) diffused between diffused pads, said bridge covered by a facilitating layer of sublimable material (125);

(b) mounting the precursor charge (106) in intimate contact with said facilitating layer (125) covering said bridge (120) of said monolithic semiconductor igniter, such that said facilitating layer of sublimable material is intermediate to said bridge (120) and said charge (106); and, (c) applying to said igniter, a low voltage in the order if about 10V and a current of about 3A, for about 25 milliseconds, such that said bridge acts as a thermal element to ignite the charge of explosive material, whereby said ignition is facilitated by said facilitating layer of sublimable material.

29. A process for igniting a precursor charge (106) of explosive material, comprising (a) providing a monolithic semiconductor igniter, including at least one bridge (120) diffused between diffused pads, said at least one bridge covered with a facilitating layer of sublimable material (125);

(b) mounting the precursor charge (106) in intimate contact with said facilitating layer (125) covering said bridge (120) of said monolithic semiconductor igniter, such that said facilitating layer of sublimable material is intermediate to said bridge (120) and said charge (106); and, (c) applying to said igniter, a high voltage in the order of about 100V and a current of between about 10A and 20A, for about 10 microseconds, such that said bridge acts as a plasma generator to ignite the charge of explosive material, whereby said ignition is facilitated by said facilitating layer of sublimable material.

* * * * *